United States Patent [19]

Vaughn et al.

[11] Patent Number: 4,785,716

[45] Date of Patent: Nov. 22, 1988

[54] PNEUMATIC CYLINDER AND BRAKE MECHANISM THEREFOR

[75] Inventors: Jerry E. Vaughn, Bloomington; Gary W. Rosengren, Brooklyn Park; Jeffrey A. Naab, Minneapolis, all of Minn.

[73] Assignee: Tol-O-Matic, Inc., Minneapolis, Minn.

[21] Appl. No.: 20,093

[22] Filed: Feb. 27, 1987

[51] Int. Cl.[4] ..... F15B 15/26

[52] U.S. Cl. ..... 92/23; 92/24; 92/18; 92/27; 92/28; 92/88

[58] Field of Search ..... 92/88, 75, 50, 69, 23, 92/24, 27, 28, 18

[56] References Cited

U.S. PATENT DOCUMENTS

| | | | |
|---|---|---|---|
| 3,470,793 | 10/1969 | Hanchen | 92/28 |
| 4,419,924 | 12/1983 | Peter et al. | 92/88 |
| 4,537,113 | 8/1985 | Stoll et al. | 92/27 |
| 4,664,020 | 5/1987 | Kaiser | 92/88 |
| 4,724,744 | 2/1988 | Rosengren | 92/88 |

*Primary Examiner*—Robert E. Garrett
*Assistant Examiner*—Thomas Denion
*Attorney, Agent, or Firm*—Dorsey & Whitney

[57] ABSTRACT

A pneumatic cylinder having an elongated cylinder member, a reciprocally movable piston, transfer means for transferring reciprocal movement of the piston to a work piece and a brake mechanism associated and movable with the transfer means for creating a braking force between the transfer means and a portion of the cylinder member. The brake mechanism includes a first brake surface connected with the transfer means, a second brake surface formed by an exterior surface portion of the cylinder member and a brake actuation mechanism for selectively causing movement of the first and second brake surfaces into braking engagement with one another.

19 Claims, 3 Drawing Sheets

PNEUMATIC CYLINDER AND BRAKE MECHANISM THEREFOR

BACKGROUND OF THE INVENTION

The present invention relates generally to an improvement in a pneumatic cylinder, and more particularly, to a pneumatic cylinder such as a cable cylinder, a rodless cylinder or the like having a mechanism for causing braking of the piston during operation.

Several types of power cylinders currently exist in the art including, among possible others, cable cylinders and rodless or band cylinders. Although the improvement of the present invention has application to all types of pneumatic cylinders including cable cylinders or band cylinders, it has particular application to rodless cylinders of the type generally described in U.S. Pat. No. 4,545,290. Such a rodless, pneumatic cylinder includes an elongated cylinder member, an elongated, longitudinally extending slot, a piston reciprocally movable within the cylinder member, a sealing means for successively sealing the slot during reciprocal movement of the piston and a piston bracket or other transfer means for transferring the reciprocal movement of the piston to a work piece or load outside of the cylinder. In one rodless cylinder for which the present invention has particular applicability, a piston bracket is connected to a carrier bracket of the type described U.S. Pat. No. 4,724,744 issued Feb. 16, 1988, the disclosure of which is incorporated herein by reference. In this structure the work piece or load is connected to the carrier bracket.

The carrier bracket of the above described structure includes a centrally located portion for connection with the piston bracket and a pair of spaced arms which extend outwardly from the central portion and partially around the body of the cylinder. The outer extremities of these arms carry a bearing rod or other means for sliding relationship with corresponding bearing channels or grooves in the side walls of the cylinder. During normal operation, the respective positions of these bearing rods are adjusted with sufficient clearance relative to the guide grooves to permit reciprocal movement of the carrier bracket and piston relative to the cylinder.

During the operation of such a cylinder, it is often desirable to stop the movement of the piston in the middle of a stroke. One way to do this, of course, would be to reduce or stop the supply of pneumatic power being supplied to drive the piston or to pressurize the opposite chamber so that the pressure in the respective chambers is equalized. While this will result in the piston eventually stopping and thus be satisfactory for some purposes, it often involves fairly complicated and expensive pneumatic fluid control mechanisms. Further, there is generally insufficient control over the exact position at which the piston is stopped by this method and doesn't provide for inertial forces of the load. Still further, such a means would permit the piston to drift because of the equal pressure in both chambers and the absence of any positive braking means.

Another means for stopping or braking a specific type of band cylinder is embodied in a device manufactured by Mosier Industries Incorporated of Brookville, Ohio. Such device utilizes an inflatable bladder or other means which expand into braking engagement with the inside surface of a tubular portion of the cylinder. Although this device may be satisfactory for certain applications, it is limited to a particular type of pneumatic cylinder and requires a cylinder member significantly larger than what would normally be required. Thus, it is quite expensive and cumbersome.

Accordingly, there is a real need for an improved pneumatic cylinder having an improved brake mechanism which can be utilized to stop reciprocal movement of the piston when desired.

SUMMARY OF THE INVENTION

In accordance with the present invention, and in contrast to the prior art, a pneumatic cylinder is provided with an improved brake or stop mechanism which permits the piston bracket to be stopped at any point during the reciprocation of the piston assembly and the attached load or work piece.

More specifically, the braking device of the present invention includes a cylinder member, a piston reciprocally movable therein, a transfer means for transferring reciprocal movement of the piston to the work piece and a brake mechanism comprising a first friction or brake element connected with the transfer means, a second friction or brake element connected with an outer surface the cylinder member and means for selectively causing movement of the first and second friction or brake elements into frictional engagement with one another to stop or brake the piston.

The preferred embodiment of the present invention describes an improved brake mechanism for use with a rodless cylinder with a carrier bracket of the type having a pair of arms extending outwardly from a central portion and partially around the outside of the cylinder. These arms carry a bearing rod for sliding relationship with respect to guide grooves in the side walls of the cylinder during normal operation. The brake mechanism of this preferred embodiment includes providing each side of the carrier bracket with a brake cylinder having a mechanism, actuated by pneumatic pressure, for causing inward or pinching movement of the respective bearing rods into frictional engagement with the bearing grooves in the side walls of the cylinders to stop movement of the piston assembly and thus the work piece.

Accordingly, it is an object of the present invention to provide an improved pneumatic cylinder having an improved mechanism for stopping or applying a braking force to the reciprocating piston and work piece.

Another object of the present invention is to provide an improved pneumatic cylinder of the type having a carrier bracket with a braking mechanism incorporated therein.

A further object of the present invention is to provide a pneumatic cylinder with a carrier bracket of the type having a pair of outwardly extending arms and a bearing rod for engagement with bearing portions on the sides of the cylinder and with an improved brake mechanism comprising means for exerting an inward force on the respective bearing rods so that the braking force results from frictional engagement between the bearing rods and the side walls of the cylinder.

A still further object of the present invention is to provide a pneumatic cylinder of the type having a carrier bracket with means in the form of wedge elements for causing an inward braking force to be applied against the bearing rods carried by the carrier bracket.

These and other objects of the present invention will become apparent with reference to the drawings, the description of the preferred embodiment and the appended claims.

DESCRIPTION OF THE PREFERRED EMBODIMENT

Figure 1:
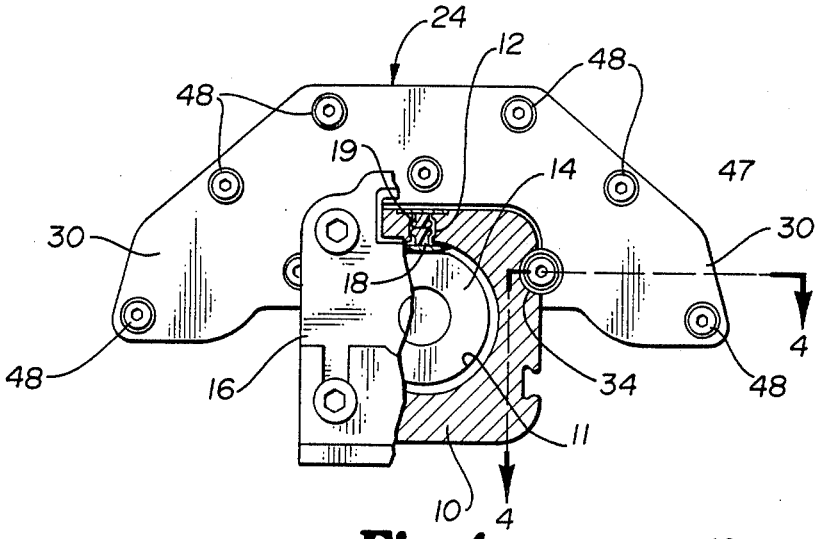
FIG. 1 is an elevational end view, partially in section, of the pneumatic cylinder of the present invention.
Figure 2:
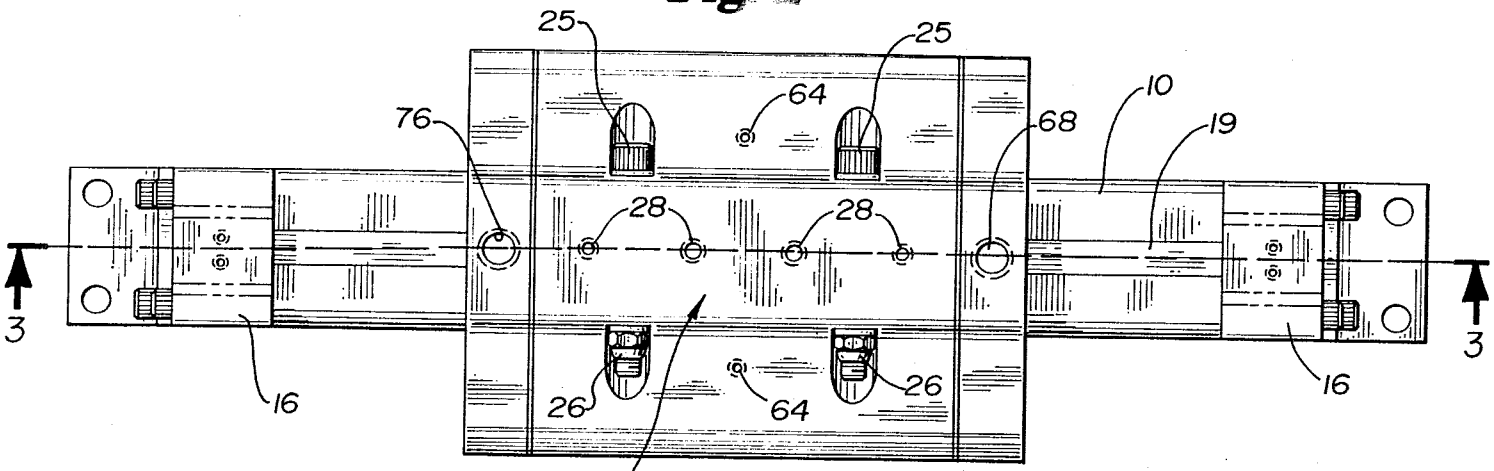
FIG. 2 is an elevational top view of the pneumatic cylinder of the present invention.
Figure 3:
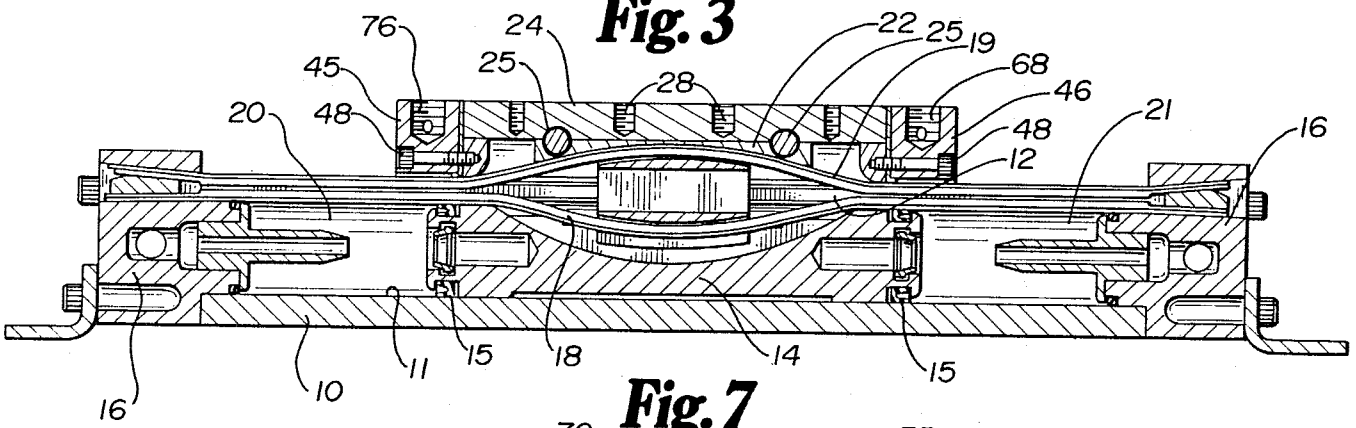
FIG. 3 is a cross-sectional view of the pneumatic cylinder of the present invention as viewed along the section line 3—3 of FIG. 2.

Reference is first made to FIGS. 1, 2 and 3 showing various views of the improved pneumatic cylinder of the present invention. It should be noted that although the description of the preferred embodiment relates to a rodless cylinder, the features and advantages are applicable to other types of pneumatic cylinders as well. The pneumatic cylinder as shown in the preferred embodiment includes an elongated cylinder member 10 having an elongated cylindrically shaped bore 11 extending therethrough and an elongated slot 12 which extends the entire length of the cylinder 10 in a direction generally parallel to its longitudinal axis. Disposed within the cylinder 10 and bore 11 is a reciprocally movable piston 14 having appropriate seals 15 (FIG. 3) at each end for sealing engagement with the bore 11. A pair of end or head assemblies 16 are connected with the ends of the cylinder member 10 by appropriate connection means. Elongated inner and outer seal members 18 and 19, respectively, are adapted for insertion into, and sealing relationship with respect to, the slot 12. With the above structure, a pair of pneumatic chambers 20 and 21 (FIG. 3) are formed in opposite ends of the cylinder member 10. Each of these pneumatic chambers 20 and 21 is defined by a portion of the cylinder bore 11, a portion of the inner seal member 18 and respective ends of the head assemblies 16 and the piston gaskets 15. By selectively introducing pneumatic pressure into these pneumatic chambers 20 and 21, the piston 14 is caused to move in reciprocal movement back and forth within the bore 11 of the cylinder 10. The details of such a pneumatic cylinder construction are set forth in greater detail in U.S. Pat. No. 4,545,290, the disclosure of which is incorporated herein by reference.

With specific reference to FIGS. 2 and 3, the piston 14 is connected with a piston bracket 22 which moves with the piston 14 and extends upwardly through the elongated slot 12 for connection with a carrier bracket 24. This connection between the carrier bracket 24 and the piston bracket 22 is accomplished by a pair of threaded members 25, and corresponding lugs 26, extending through portions of the carrier bracket 24 and piston bracket 22. The carrier bracket 24 includes a plurality of threaded openings 28 in its top surface for connection with a desired workpiece or load (not shown).

Figure 4:
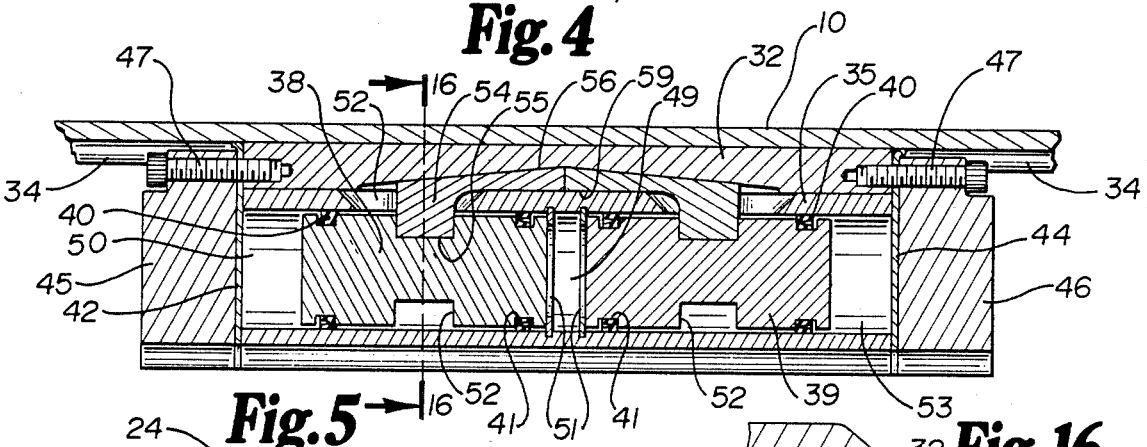
FIG. 4 is a cross-sectional view of one of the brake cylinders incorporated in the pneumatic cylinder of the present invention as viewed along the section line 4—4 of FIG. 1.

As illustrated best in FIGS. 1, 4, 5 and 16, it can be seen that the carrier bracket 24 includes a pair of leg members 30 extending outwardly from a central portion 29 (FIG. 5) so that the leg members 30 extend outwardly and partially around a portion of the cylinder member 10. An inwardly facing portion of each of these leg members 30 includes a semi-cylindrically shaped bearing rod seat 31 which forms a seat for the bearing rod 32 (FIGS. 1 and 4). Each of the side walls of the cylinder member 10 is provided with a corresponding bearing groove 34 to receive the bearing rod 32 in sliding relationship. During normal operation, the bearing rod 32 is provided with a slight clearance relative to the bearing groove 34 to provide for smooth and efficient sliding movement, while still functioning to guide and stabilize the carrier bracket 24 and workpiece relative to the piston 14. The normal adjustment for this clearance is accomplished by tightening or loosening the lugs 26 relative to the threaded members 25 (FIG. 2). In the preferred embodiment, the lug members 30 are prestressed outwardly to permit this adjustment for proper clearance. In the preferred embodiment the rods 32 are shown to be cylindrical, however, they could have various other cross-sectional configurations as well. If they do, the grooves 34 would be shaped accordingly.

In general, the improvement of the present invention includes providing a pneumatic cylinder with a brake mechanism. This includes providing the transfer means or carrier bracket with a first friction or brake surface, providing the cylinder member with a second friction or brake surface and providing means for selectively moving the first and second friction of brake surfaces into frictional engagement with one another to create the braking force. With respect to the pneumatic cylinder structure of the preferred embodiment, the brake mechanism is activated by a separate source of pneumatic fluid pressure which is supplied to appropriate activation and deactivation ports 68 and 76, respectively, in the carrier bracket 24. This separate source of pneumatic fluid pressure is utilized to create, or increase, frictional engagement between a portion of the outwardly extending carrier bracket arms 30 and side wall portions of the cylinder member 10. As will be described in greater detail below, the preferred embodiment includes means for causing an inward force to be exerted on a portion of each of the bearing rods 32. This causes the bearing rods 32 to be forced inwardly into frictional engagement with the bearing groove 34 in the side walls of the cylinder member 10, thereby generating enough frictional or clamping force to stall further movement of the piston 14. Such a braking action is sufficient to stop reciprocal movement of the piston 14 even when pneumatic pressure is being supplied to one or the other of the pneumatic chambers 20 or 21 (FIG. 3).

As illustrated best in FIG. 4, the means for selectively creating the braking force between the transfer means or carrier bracket 24 and the cylinder member 10 is provided by a pair of brake actuation cylinders disposed on opposite sides of the cylinder member 10. One of these brake actuation cylinders is embodied within one of the outwardly extending leg portions 30 of the carrier bracket 24 on one side of the member 10, while the other is embodied within the other leg portion 30 in the other side of the member 10. For purposes of the present description, only one of these actuation cylinders will be shown and described.

Figure 5:
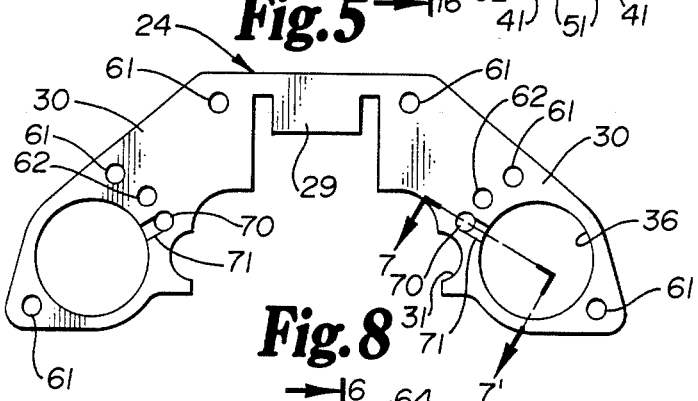
FIG. 5 is an elevational end view of the carrier bracket housing of the pneumatic cylinder of the present invention.
Figure 16:
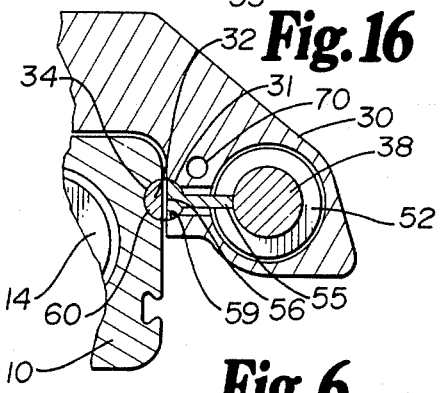
FIG. 16 is a cross-sectional view of a portion of the pneumatic cylinder of the present invention as viewed along the section line 16—16 of FIG. 4.

Reference is made next to in FIG. 4 which is a cross-sectional view of the brake actuation cylinder housed within one of the outwardly extending legs 30 on one side of the cylinder member 10 and FIG. 5 which is an elevational view of one end of the carrier bracket housing with the manifold members, the gaskets and piston elements removed. Each of the brake actuation cylinders extends in a direction generally parallel to the primary cylinder 10 and includes a cylinder housing 35 formed by a portion of the outwardly extending arm 30 of the carrier bracket 24 which includes an elongated, generally cylindrical bore 36 extending therethrough in a direction generally parallel to the longitudinal axis of the cylinder member 10. Disposed within the bore 36 is a pair of spaced piston members 38 and 39. Each of these pistons 38 and 39 is provided with an outer or deactivation chamber O-ring 40 and an inner or activation chamber O-ring 41. These O-rings 40 and 41 are spaced from one another and are disposed around a peripheral portion of the pistons 38 and 39 to form a seal between the pistons 38 and 39 and the bore 36.

Associated with the ends of each brake actuation cylinder are gaskets 42 and 44 and manifolds 45 and 46. In the preferred embodiment, as will be described in greater detail below, the gasket 42 is a deactivation gasket and the manifold 45 is a deactivation manifold, while the gasket 44 is an activation gasket and the manifold 46 is an activation manifold. The manifolds 45 and 46 are connected with the main housing of the carrier bracket 24 by a plurality of threaded members 48 (FIGS. 1, 2 and 4). Threaded members 47 also extend through the manifolds 45 and 46 and into the ends of the rods 32 to secure the rods to the carrier bracket 24.

In the above described structure, a brake actuation chamber 49 is formed between the pistons 38 and 39. Such chamber 49 is defined by the inner surfaces of the pistons 38 and 39, the O-rings 41 and a portion of the bore 36. A pair of deactivation chambers 50 and 53 are formed between the gaskets 42, 44 and the outer ends of each of the pistons 38 and 39. Specifically, the deactivation chamber 50 is defined by the outer end of the piston 38, one of the O-rings 40, the gasket 42 and a portion of the bore 36, while the deactivation chamber 53 is defined by the outer end of the piston 39, the other of the O-rings 40, the gasket 44 and a portion of the bore 36. A pair of retaining rings are disposed within the bore 36 of the brake cylinder 35 for the purpose of limiting the movement of the pistons 38 and 39 toward one another.

Figure 17:
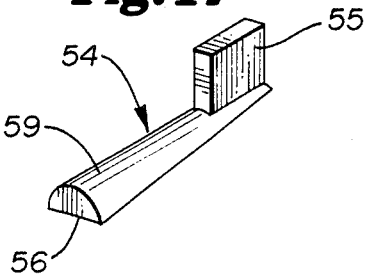
FIG. 17 is a pictorial view of the brake wedge utilized in the present invention.
Figure 15:
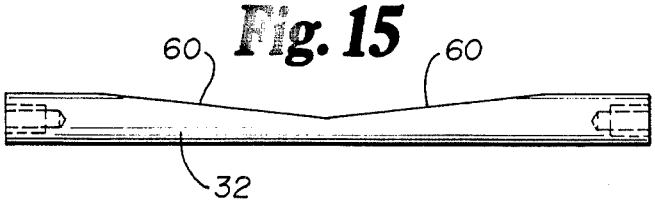
FIG. 15 is an elevational top view of one of the bearing rods for the pneumatic cylinder of the present invention.

Each of the brake pistons 38 and 39 includes a centrally positioned annular recess 52 extending around the entire periphery of the pistons 38 and 39. Disposed within this annular recess 52 of each of the pistons 38 and 39 is a tang or tab portion 55 of a brake wedge 54. As illustrated best in FIGS. 16 and 17, this brake wedge 54 includes a semi-cylindrical surface 59 for engagement with the semi-cylindrical bearing surface 31 of the carrier bracket housing (FIG. 5). As shown best in FIGS. 4 and 17, the brake wedge 54 also includes a bevelled or inclined ramp surface 56 for engagement with a corresponding ramp surface 60 on the bearing rod 32 (FIG. 15). The tangs or tabs 55 of the brake wedge members 54 extend through openings 58 in the cylinder housing wall 35 and into the annular recessed portions 52 of the pistons 38 and 39.

It can be seen that if, during operation of the pneumatic cylinder of the present invention, pneumatic fluid pressure is introduced into the actuation chamber 49, the pistons 38 and 39 will be caused to move outwardly and away from one another. This outward movement also causes movement of the brake wedges 54, 54 away from one another as a result of engagement between the tab 55 and the annular recess 52 in the pistons 38 and 39. As a result of this outward movement of the brake wedges 54, the bevelled force exerting surface 56 of each of the brake wedges 54 bears against its corresponding bevelled surface 60 (FIG. 15) of the bearing rod 32, thereby forcing the bearing rod 32 into frictional and braking engagement with the bearing groove 34 of the cylinder side wall. Because of the mechanical advantage developed by the relatively shallow ramp angle of the bevelled surfaces 56 (FIG. 4) and 60 (FIG. 15), the brake device is able to transmit enough clamping or frictional force against the bearing grooves 34 to brake the cylinder piston 14 and to stop moderate inertia loads that may be attached to the carrier bracket 24.

The above mentioned braking force will be exerted as long as there is sufficient pneumatic pressure within the brake activation chamber 49. To release the braking action, the chamber 49 is vented and pneumatic pressure is introduced into the brake deactivation chambers 50, 53 located at the outer ends of the pistons 38 and 39. Such pressure exerts an inward force on the pistons 38 and 39, thereby causing them to move toward one another until they come to rest against the retaining rings 51. During this movement of the pistons 38 and 39 toward one another, the brake wedge members 54, as a result of engagement between the tabs 55 and the recessed areas 52, are caused to move toward one another, thus releasing the wedge force existing between the inclined surface 56 of the wedge member 54 and the corresponding inclined surface 60 (FIG. 15) of the bearing rod 32. When the braking action is released, the reciprocation of the cylinder piston 14 continues.

Figure 8:
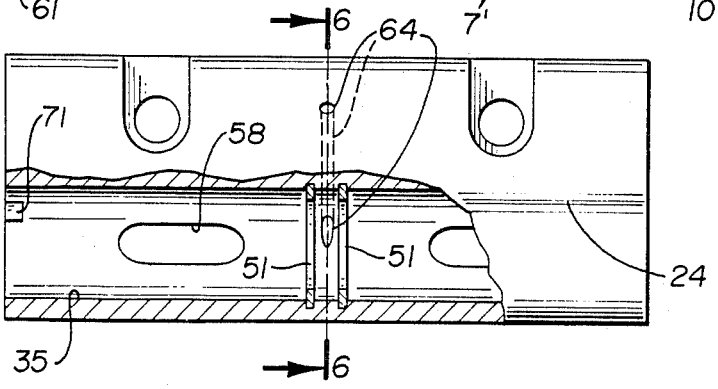
FIG. 8 is an elevational side view, partially in section with parts broken away showing a portion of the carrier bracket housing.
Figure 6:
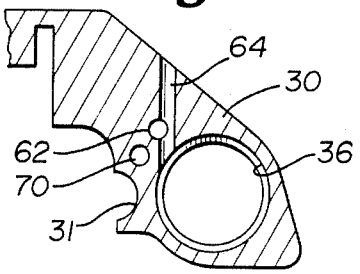
FIG. 6 is a cross-sectional view of a portion of the carrier bracket housing showing the brake activation port as viewed along the section line 6—6 of FIG. 8.

Having described the general function and operation of the brake mechanism of the present invention, the detailed description of the brake cylinders can be understood as follows. With reference to FIG. 5, each end of the carrier bracket housing includes a plurality of threaded openings 61 to receive the threaded connection screws 48 extending through the manifold members 45 and 46. Each of the leg portions 30 of the carrier bracket housing also includes an activation port 62 which extends from the activation end of the housing to a point about midway along the housing. As illustrated in FIG. 6, a generally vertical hole 64 is drilled through a portion of each of the legs 30 so that it intersects both the activation port 62 and the cylinder bore 36. As shown best in FIG. 8, the hole 64 is drilled approximately midway between the ends of the carrier bracket 24 so that it intersects the bore 36 in the area of the brake activation chamber 49 between the pistons 38 and 39. The top of the hole 64 is then tapped and an appropriate plugis inserted to close the same.

Figure 9:
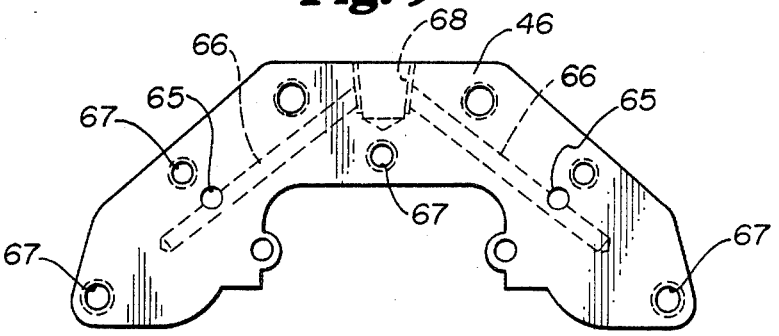
FIG. 9 is an elevational view of the activation manifold for the pneumatic cylinder of the present invention showing the activation ports in broken lines.
Figure 10:
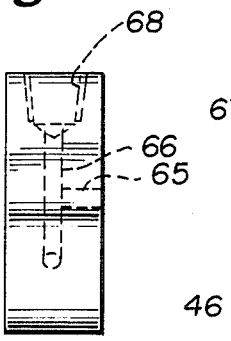
FIG. 10 is an elevational side view of the activation manifold for the pneumatic cylinder of the present invention showing the activation ports in broken lines.
Figure 11:
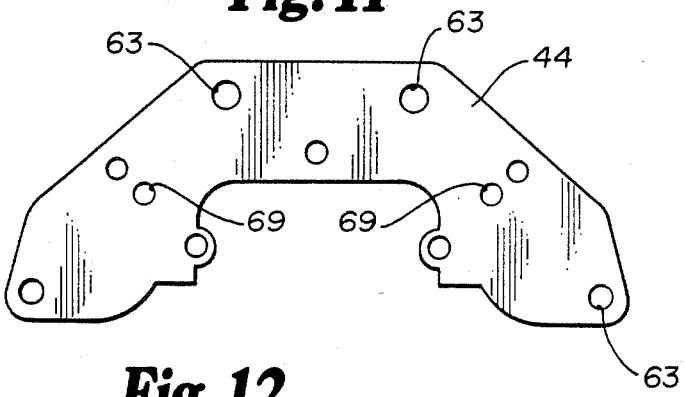
FIG. 11 is an elevational view of the activation gasket for the pneumatic cylinder of the present invention.

The activation gasket 44 and the activation manifold 46 illustrated in FIGS. 11 and 9, respectively, are connected with the activation end of the carrier bracket housing and are provided with appropriate openings or ports which are aligned with the activation port 62. Specifically, as illustrated in FIGS. 9 and 10, the ports 65 which extend from the inner surface of the activation manifold 46 and partially through such manifold are in direct alignment with the activation ports 62 when the device is assembled. Each of the ports 65 is in communication with a diagonal port 66 which in turn is in communication with the primary activation port 68 in the top of the carrier bracket 24. The remaining holes 67 are adapted to receive the bolts 48 to connect the manifold 46 to the carrier bracket housing.

The activation gasket 44 has a configuration similar to that of the activation manifold 46 and also includes a pair of ports or openings 69 which, when assembled, is aligned with the ports 65 of the activation manifold 46 and the activation ports 62 within the carrier bracket housing. Thus, by introducing pneumatic pressure into the primary activation port 68 (FIGS. 1, 9 and 10), the pneumatic pressure is directed through the ports 66 and 65 in the manifold 46, through the hole 69 in the gasket 44, through the ports 62 and 64 in the carrier bracket housing and into the brake activation chamber 49 (FIG. 4) within the brake actuation cylinder.

Figure 7:
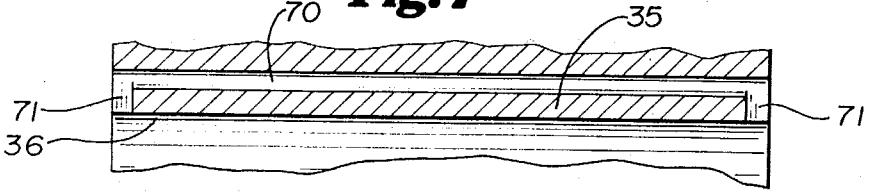
FIG. 7 is a cross-sectional view of a portion of the carrier bracket housing of the pneumatic cylinder of the present invention showing the deactivation port as viewed along the section line 7—7 of FIG. 5.

Referring again to FIG. 5, each leg 30 of the carrier bracket 24 also includes an elongated deactivation port 70 extending through the entire length of the carrier bracket housing. As illustrated best in FIGS. 5 and 7, this deactivation port 70 is joined, at each of its ends by a groove or port portion 71 which connects the deactivation port 70 with the deactivation pneumatic chambers 50, 53 (FIG. 4) at the ends of the pistons 38, 39. Thus, both brake deactivation chambers 50, 53 are pneumatically joined by the deactivation port 70 and the portions 71.

Figure 13:
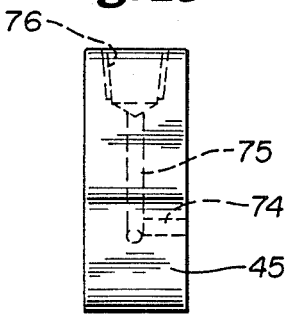
FIG. 13 is an elevational side view of the deactivation manifold for the pneumatic cylinder of the present invention showing the deactivation ports in broken lines.
Figure 12:
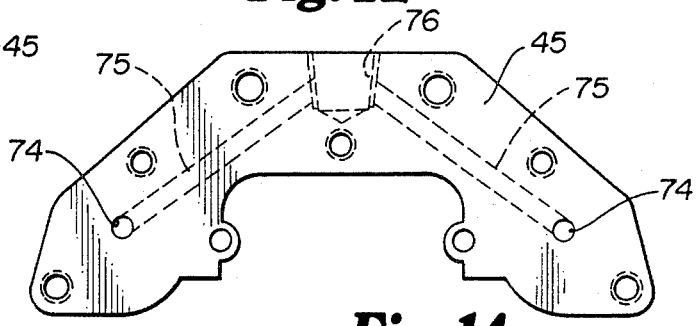
FIG. 12 is an elevational view of the deactivation manifold for the pneumatic cylinder of the present invention showing the deactivation ports in broken lines.
Figure 14:
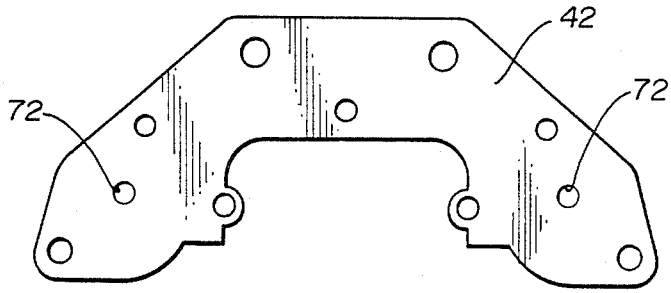
FIG. 14 is an elevational view of the deactivation gasket for the pneumatic cylinder of the present invention.

The deactivation gasket 42 (illustrated in FIG. 14) and the deactivation manifold 45 (illustrated in FIGS. 12 and 13) each contain a pair of openings or ports for communication with the brake deactivation chamber at the deactivation end of the brake actuation cylinder. As shown in FIG. 14, the deactivation gasket 42 includes an opening 72 which is in direct communication with the brake deactivation chamber 50. The deactivation manifold includes a port 74 which is in alignment with the hole 72 in the deactivation gasket 42 and a pair of inclined ports 75 intersecting the ports 74 and the primary deactivation port 76 (FIGS. 2, 12 and 13) positioned on top of the carrier bracket 24.

By introducing pneumatic pressure into the primary deactivation port 76, the pressure is directed through the ports 75 and 74 in the manifold 45, through the opening 72 in the gasket 42 and into the deactivation chamber 50. This pressure is also directed through the port 70 and the grooves 71 into the deactivation chamber 53. Such pneumatic pressure causes the pistons 38 and 39 to move inwardly toward one another, thus also causing inward movement of the brake wedges 54. This results in corresponding release of the brake force in the manner described previously.

During the activation and deactivation of the brake members as described above, the exhaust of pneumatic pressure from the respective activation and deactivation chambers occurs through the same ports and openings which were used to activate such chambers.

Although the description of the preferred embodiment has been quite specific, it is contemplated that various changes and modifications could be made without deviating from the spirit of the present invention. Accordingly, it is intended that the scope of the present invention be dictated by the appended claims rather than by the description of the preferred embodiment.

We claim:

1. A pneumatic cylinder comprising:

an elongated cylinder member having an elongated bore extending therethrough;

a piston disposed within said bore and adapted for reciprocal movement therein;

transfer means connected with said piston for transferring reciprocal movement of said piston to a workpiece including a carrier bracket having a combination guide and brake means for selectively guiding the reciprocal movement of said carrier bracket relative to said cylinder member and braking said carrier bracket relative to said cylinder member, said combination guide and brake means including a pair of spaced leg portions extending outwardly from a central portion wherein each of said leg portions includes an elongated bearing member, said bearing member cooperating with a corresponding bearing surface on an exterior surface portion of said cylinder member to selectively guide the reciprocal movement of said carrier bracket relative to said cylinder member, said combination guide and brake means further including a first brake surface formed by a portion of each of said bearing members, a second brake surface formed by a portion of each of said corresponding bearing surfaces and brake actuation means for selectively causing movement of said first and second brake surfaces into braking engagement with one another to selectively brake said carrier bracket relative to said cylinder member.

2. The cylinder of claim 1 wherein said brake actuation means includes pneumatically actuated means.

3. The cylinder of claim 1 wherein said brake actuation means includes at least one brake actuation cylinder for selectively causing movement of said first and second brake surfaces into braking engagement with one another.

4. The cylinder of claim 3 wherein said brake actuation cylinder is disposed in a direction generally parallel to said elongated cylinder member and includes a pair of pneumatically operated pistons movable therein.

5. The cylinder of claim 3 wherein said brake actuation cylinder includes a piston reciprocally movable therein and force generating means operatively connected with said piston whereby reciprocal movement of said piston causes said force generating means to selectively move said first and second brake surfaces into and out of braking engagement with one another.

6. The cylinder of claim 5 wherein said force generating means includes a wedge element.

7. The cylinder of claim 6 wherein said brake actuation means includes a pair of brake cylinders.

8. The cylinder of claim 1 wherein each of said bearing members includes an elongated bearing rod and each of said second brake surface includes an elongated bearing groove formed in a portion of said cylinder member.

9. The cylinder of claim 8 wherein said brake actuation means includes a brake actuation cylinder in each of said leg portions and extending generally parallel to said elongated cylinder member.

10. The cylinder of claim 9 wherein each of said brake actuation cylinders includes a reciprocally movable piston and force generating means operatively connected with said piston to selectively move said bearing rod into and out of braking engagement with said bearing groove.

11. The cylinder of claim 10 wherein said force generating means includes a wedge member.

12. The cylinder of claim 11 wherein said wedge member includes an inclined surface for engagement with a portion of said bearing rod.

13. The cylinder of claim 12 wherein said bearing rod includes an inclined surface portion for corresponding engagement with said inclined surface of said wedge member.

14. The cylinder of claim 13 wherein each of said brake actuation cylinders includes a pair of reciprocally movable pistons.

15. The cylinder of claim 13 wherein said leg portions extend outwardly and around a portion of said cylinder member whereby said bearing grooves are disposed on opposite side walls of said cylinder member.

16. The cylinder of claim 9 wherein said leg portions extend outwardly and around a portion of said cylinder member whereby said bearing grooves are disposed on opposite side walls of said cylinder member.

17. The cylinder of claim 9 wherein said leg portions extend outwardly and around a portion of said cylinder member whereby said bearing grooves are disposed on opposite side walls of said cylinder member

18. The cylinder of claim 17 wherein said brake actuation cylinders are pneumatically actuated.

19. The cylinder of claim 1 wherein each of said bearing rods is secured at its ends to said carrier bracket and wherein the portion of said bearing rods between its ends is selectively movable toward and away from said corresponding bearing surface by said brake actuation means.

* * * * *